US007845720B2

(12) United States Patent
Randall

(10) Patent No.: US 7,845,720 B2
(45) Date of Patent: Dec. 7, 2010

(54) SCUBA EQUIPMENT ASSEMBLY PLATFORM

(76) Inventor: Carl Wells Randall, 2815 Douglas Way, Corona, CA (US) 92882

( * ) Notice: Subject to any disclaimer, the term of this patent is extended or adjusted under 35 U.S.C. 154(b) by 0 days.

(21) Appl. No.: 12/533,996

(22) Filed: Jul. 31, 2009

(65) Prior Publication Data

US 2010/0052371 A1 Mar. 4, 2010

Related U.S. Application Data

(60) Provisional application No. 61/092,020, filed on Aug. 26, 2008.

(51) Int. Cl.
*A47C 7/62* (2006.01)
*A45F 4/02* (2006.01)

(52) U.S. Cl. ..... 297/188.04; 297/188.08; 297/45; 224/155

(58) Field of Classification Search ..... 297/188.04, 297/188.06, 45, 188.08; 224/155
See application file for complete search history.

(56) References Cited

U.S. PATENT DOCUMENTS 2,563,114 A * 8/1951 Huber ..... 297/188.04 X
3,970,344 A * 7/1976 Baumann ..... 297/188.02
3,971,591 A * 7/1976 Ziaylek ..... 297/188.04
4,276,851 A 7/1981 Coleman
4,431,206 A * 2/1984 Pryor ..... 297/188.06 X
4,506,903 A * 3/1985 Bowermaster ..... 297/188.2 X
4,566,731 A 1/1986 Marchesini
4,618,184 A 10/1986 Harvey
4,676,548 A * 6/1987 Bradbury ..... 297/188.04 X
4,696,420 A 9/1987 Kulik
4,739,913 A * 4/1988 Moore ..... 224/643
4,815,761 A 3/1989 Henderson
4,974,903 A * 12/1990 Lipschitz et al. .... 297/188.06 X
4,996,982 A * 3/1991 Williamson ..... 128/205.24
5,131,670 A 7/1992 Clements et al.
5,139,308 A * 8/1992 Ziman ..... 297/188.06
5,213,392 A * 5/1993 Bostrom et al. ..... 297/188.04
5,253,760 A * 10/1993 Miller ..... 224/901.4 X
5,259,372 A * 11/1993 Gross et al. ..... 128/200.24
5,275,462 A * 1/1994 Pond et al. ..... 297/188.04
5,288,001 A 2/1994 Locarno
5,340,140 A * 8/1994 Bynum ..... 297/188.02 X
5,354,029 A * 10/1994 Ziaylek et al. ..... 297/188.04 X
5,641,197 A * 6/1997 Springmann ..... 297/188.04 X
5,681,080 A * 10/1997 Pond et al. ..... 297/188.04 X
5,733,000 A * 3/1998 Stump ..... 297/188.06
5,741,020 A 4/1998 Harroun (Continued)

*Primary Examiner*—Rodney B White
(74) *Attorney, Agent, or Firm*—Kirk A. Buhler; Buhler & Associates

(57) ABSTRACT

A portable platform that allows for independent assembly and disassembly of SCUBA diving equipment comprised of a folding seating implement with a pair of front, rear and side crossed legs, a seating means, a backrest and armrests. An additional plurality of seating implement legs is pivotally connected to the posterior portions of the back crossed legs and connected at their lower portions. A concave vertical recess is located along the midline of the seating implement backrest that extends from the concave recess located at the midline rear portion of the seating implement seating means to the top edge of the seating implement backrest. At least one linear nylon support strip is connected at each lateral side of the seating implement backrest and extends laterally across a back portion of the seating implement backrest. A plurality of pouch pockets is connected to each lateral side of the seating means.

19 Claims, 6 Drawing Sheets

U.S. PATENT DOCUMENTS 5,803,544 A * 9/1998 Block et al. ..... 297/188.04 X
5,887,888 A * 3/1999 Tseng ..... 297/188.04 X
5,934,749 A * 8/1999 Pond et al. ..... 297/188.04
5,984,406 A * 11/1999 Lee ..... 297/45 X
6,036,262 A * 3/2000 Shahid ..... 297/188.04
6,048,023 A * 4/2000 Lampton ..... 297/188.06 X
6,149,238 A * 11/2000 Tsai ..... 297/45 X
6,209,951 B1 * 4/2001 Han ..... 297/45
6,264,271 B1 * 7/2001 Munn et al. ..... 297/45
6,270,156 B1 8/2001 Metzger et al.
6,322,138 B1 * 11/2001 Tang ..... 297/45
6,367,674 B1 * 4/2002 Tabor ..... 224/650
6,382,715 B1 * 5/2002 Tang ..... 297/45 X
6,419,311 B1 * 7/2002 Tang ..... 297/45
6,464,118 B2 * 10/2002 McUmber ..... 224/155
6,499,804 B1 * 12/2002 Wu ..... 297/45 X
6,547,324 B1 * 4/2003 Ammann, Jr. ..... 297/188.04 X
6,601,912 B1 * 8/2003 Chen ..... 297/45
6,601,923 B2 * 8/2003 Pond et al. ..... 297/188.04 X
6,629,722 B1 * 10/2003 Tang ..... 297/45
6,644,731 B2 * 11/2003 Tang ..... 297/45 X
6,655,745 B2 * 12/2003 Fohrenkamm et al. ..... 297/188.04 X
6,662,981 B2 * 12/2003 McUmber ..... 224/155
6,682,135 B2 * 1/2004 Zheng ..... 297/45 X
6,698,827 B2 * 3/2004 Le Gette et al. ..... 297/45 X
6,702,242 B1 * 3/2004 Ziaylek et al. ..... 297/188.04 X
6,715,824 B2 * 4/2004 Zheng ..... 297/45 X
6,733,070 B2 * 5/2004 Chang ..... 297/45 X
6,755,462 B2 * 6/2004 Zheng ..... 297/45 X
6,779,838 B2 * 8/2004 Chang ..... 297/45 X
6,814,408 B2 * 11/2004 Chen ..... 297/45 X
6,817,671 B1 * 11/2004 Zheng ..... 297/45 X
6,820,927 B2 * 11/2004 Isom et al. ..... 297/45 X
6,926,355 B2 * 8/2005 Le Gette et al. ..... 297/45 X
6,942,289 B2 * 9/2005 McBride ..... 297/45 X
7,032,965 B2 4/2006 Howell et al.
7,198,324 B2 * 4/2007 Le Gette et al. ..... 297/45 X
7,201,442 B1 * 4/2007 Decosta, Jr. ..... 297/188.06 X
7,370,660 B2 * 5/2008 Hamilton et al. ..... 224/407 X
2002/0005390 A1 1/2002 DeRocher
2002/0074834 A1 * 6/2002 Summar et al. ..... 297/45 X
2004/0007903 A1 * 1/2004 Chang ..... 297/45
2004/0075311 A1 * 4/2004 Linder ..... 297/188.04
2006/0076820 A1 * 4/2006 Lackore ..... 297/188.04 X
2006/0102814 A1 5/2006 Wilk et al.
2008/0061092 A1 * 3/2008 Brownlow ..... 224/153
2009/0045657 A1 * 2/2009 Bostrom et al. ..... 297/188.04

* cited by examiner

SCUBA EQUIPMENT ASSEMBLY PLATFORM

CROSS REFERENCE TO RELATED APPLICATIONS

This application claims the benefit of Provisional 61/092,020 filed Aug. 26, 2008 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a collapsible chair. More particularly the chair is configured as a platform that allows for independent assembly and disassembly of SCUBA diving equipment to accommodate simultaneous occupancy by a diver and the SCUBA diving equipment.

2. Description of Related Art Including Information Disclosed Under 37 CFR 1.97 and 1.98

Ocean and fresh water divers disembark on their expeditions from one of two locations: off dive boats or from shorelines at beaches and lakes. Excursions that start from beaches or lakes are called "beach dives."

The SCUBA diving equipment needed for all diving comprises of a mask, gloves, an air tank, weight pouches (10 to 20 pounds), fins, a buoyancy compensator vest ("BC") and a protective suit, either a wetsuit or a dry suit. All of the equipment required for the dive can add up to over 70 pounds that the diver must get into and walk with to the diving entrance.

Due to the weight of SCUBA diving equipment, and because a fully assembled SCUBA diving equipment unit is poorly balanced when stood on its base, a diving partner or other supportive object is often needed to maintain the assembled SCUBA diving equipment upright and keep it from falling over, as a diver attempts to put on the equipment. Often the diver requires an additional person to lift the assembled SCUBA diving equipment from the ground to place it onto the diver's back. If a second individual is not readily available for assistance, other common approaches are to properly positioning the SCUBA diving equipment employ the use of a jagged sea wall, a truck tailgate, or the back end of a sports utility vehicle (SUV). In any case, the donning of SCUBA diving equipment is problematical by one's self.

Furthermore, as the process of donning SCUBA diving equipment can be awkward, divers routinely expend a great deal of energy while donning SCUBA diving equipment that has been preassembled on the ground. Some may place stress or cause injury to their lower backs over time with the strain involved in the typical approach to fashioning SCUBA diving equipment.

Various devices have been proposed to assist in assembly and/or transport of SCUBA diving equipment. The Robert M. Henderson et al., U.S. Pat. No. 4,815,761 issued on Mar. 28, 1989 titled "Amphibious SCUBA Assist Devices" was inspired to assist a diver in transporting SCUBA tanks and other diving gear across a beach or like land area. The device has a roller unit that allows the diver to transport SCUBA diving gear via a rolling mechanism, while its frame maintains the equipment above ground. The frame carries a support surface and straps to retain tanks and other gear on the device. While this patent discloses a transportation vehicle for movement of SCUBA equipment it does not assist the user in donning the SCUBA equipment by supporting or positioning the equipment at a height or position to aid the diver.

The D. Gene Clements U.S. Pat. No. 5,131,670 issued Jul. 21, 1992 titled "Detachable SCUBA Tank Overland Transport Device" similarly discloses a wheeled device for enabling a SCUBA tank or the like to be moved over ground, instead of the user having to carry it. While such a device is suitable for keeping SCUBA diving equipment off sand or dirt surfaces, it does not provide a platform atop which a SCUBA diver may expediently put on his gear. This patent application only provides for SCUBA equipment to be donned while the user is standing.

U.S. Patent Application Publication No. US 2006/0102814 published May 18, 2006 to James Wilk et al., titled "SCUBA Unit Donning Assistance Platform" discloses a standing platform that is height-adjustable for holding a SCUBA tank at about the torso level of a diver so that the diver is able to stand upright when donning a SCUBA tank. Their device includes a support and platform for supporting at least one SCUBA tank, and a securing element to hold the SCUBA tank in place atop the platform. This patent application does not disclose supporting the equipment that assists the user for donning SCUBA diving equipment. Further, this patent application only provides for SCUBA equipment to be donned while the user is standing.

U.S. Patent Application Publication No. US 2002/0005390 published Jan. 17, 2002 to Jeffrey Alan DeRocher et al., titled "Dive Equipment Washing, Drying, and Storage Rack" discloses a free-standing rack for hanging SCUBA diving equipment when not in use and particularly during cleaning, drying and storage. The rack includes at least three support legs and a plurality of dive equipment holders along its length. The rack can be readily collapsed for storage and subsequently expanded as needed for use. This patent application does not provide a seated surface for the user and as the SCUBA equipment is being donned the weight of the equipment must be supported by the user. Further, this patent application does not disclose assisting the user for donning SCUBA diving equipment.

It is desirable to provide a platform that can accommodate the sizes and shapes of various SCUBA diving equipment. In particular, it is desirable to provide a seating implement having a seating platform and backrest for the user to sit in, while in addition, providing recessed pockets in the platform and backrest of the seating implement, adjustable armrests and additional supportive seating implement legs to allow for proper placement and stabilization of SCUBA diving equipment for independent placement and removal by the user. Moreover, the user is no longer required to lift the weight of a SCUBA diving unit to its proper position.

Prior to each expedition, divers must don their SCUBA diving equipment. In the case of beach dives this is done from sandy beaches, dirty and grassy lakeshores, and dirty, oily paved side streets around the dive locations. Much of the SCUBA diving equipment preassembly is often performed on the ground, directly on the sand and dirt surfaces. Some divers will place their SCUBA diving equipment onto a thin blanket, towel or mat. In any case the proximity of the SCUBA diving equipment with the sand and dirt on beaches, lakefronts, and gritty, oily city streets, presents one of the greatest potential dangers for all divers, debris infiltration into the SCUBA diving system's air regulator (breathing unit). Consequent equipment malfunction or seal leak can then occur during the actual dive, a dangerous prospect. It is desirable to provide a platform that maintains separation between sand or other debris and the SCUBA diving equipment to be used.

BRIEF SUMMARY OF THE INVENTION

It is an object of the SCUBA equipment assembly platform to include a seating implement designed to facilitate unassisted assembly and subsequent disassembly of SCUBA equipment. The seating implement includes a seating means and backrest, each with a recess for placement of a SCUBA air tank. The seating means recess is oriented lower in relation to the seating means itself to allow for a buoyancy compensator vest that is connected to the SCUBA air tank to rest atop the shoulders of a diver seated atop the seating means. At least one adjustable armrest on each side of the seating implement to further stabilize the buoyancy compensator.

It is an object of the SCUBA equipment assembly platform to have at least one linear support strip that extends transversely across a back portion of the backrest to augment backrest sturdiness. A pair of raised posts at the upper corners of the seating implement backrest for hanging SCUBA equipment. Pouch pockets connected to each side of the seating means for storing various SCUBA equipment.

It is an object of the SCUBA equipment assembly platform to have legs of the seating implement metal tube frame, additional legs pivotally connected at the upper portions to the rear portion of the seating implement frame to provide further backload support. A support strip that connects the mid portion of at least one of the pivotally connected additional legs to the rear portion of the metal tube frame. Rubber foot pads at the lower portion of each of the device's metal tube legs.

It is another object of the SCUBA equipment assembly platform to have fluid draining eyelet holes located at the seating means, in the seating means recess and in the pouch pockets. A section of webbing, mesh or otherwise fluid draining material in the seating means.

Various objects, features, aspects, and advantages of the present SCUBA equipment assembly platform will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Referring to FIGS. 1-10, in accordance with certain preferred embodiments of the present SCUBA equipment assembly platform 16 a seating implement for assembly of SCUBA equipment is shown. Although the present SCUBA equipment assembly platform is referred to as a seating chair, it is understood that this designation is used to include other devices such as a bench, chair, stool or the like, but will be referred to as a seating chair for the purposes of the description which follows. By way of example, the seating chair is described for use in unassisted assembly of SCUBA equipment and method of use by a SCUBA diver for loading and unloading the equipment thereof. However, the seating chair can be used for the accommodation of other types of equipment or recreational gear.

Figure 1:
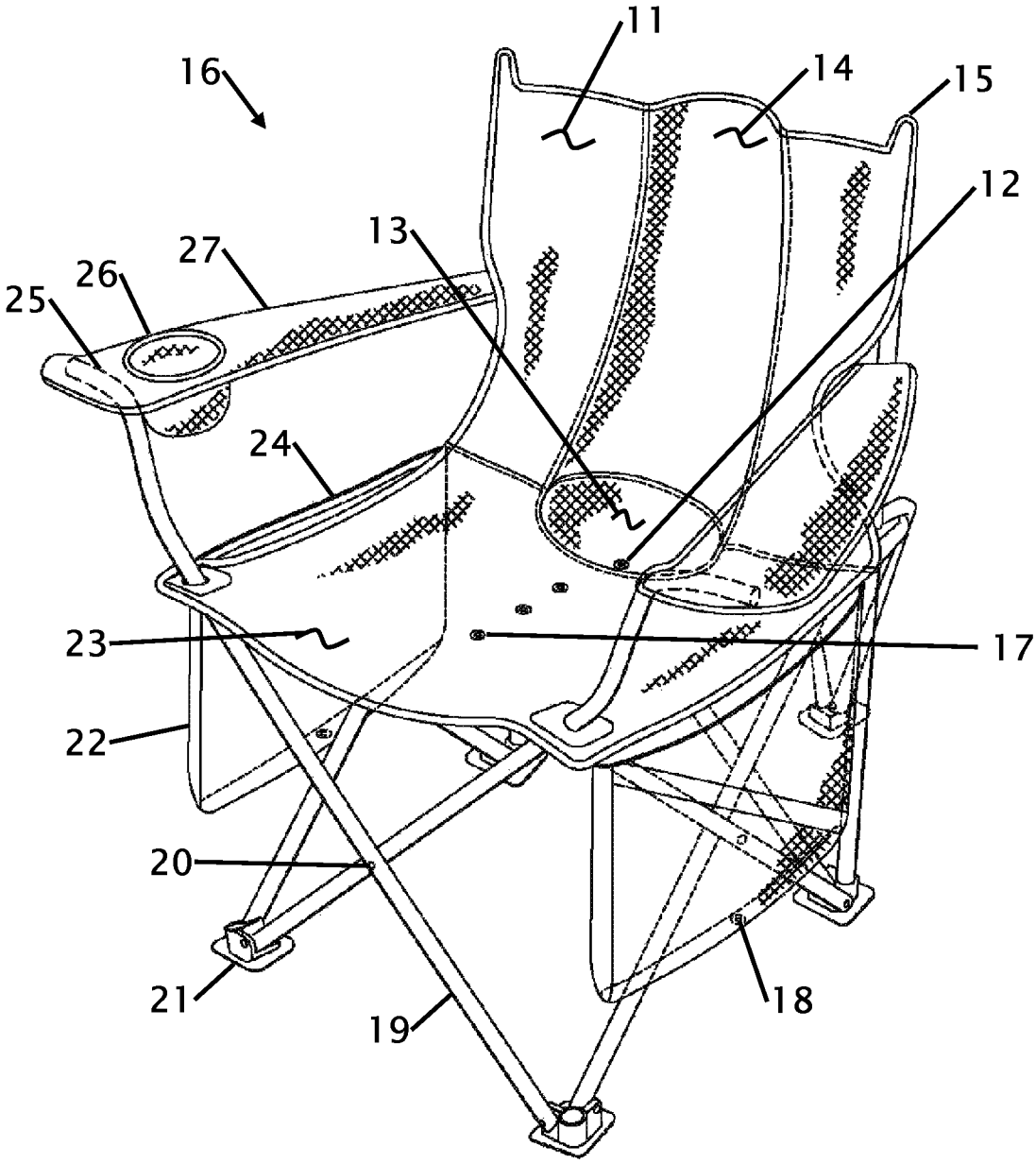
FIG. 1 shows a front oblique elevation view of a device used for unassisted SCUBA equipment assembly, in accordance with certain preferred embodiments of the SCUBA equipment assembly platform.
Figure 9:
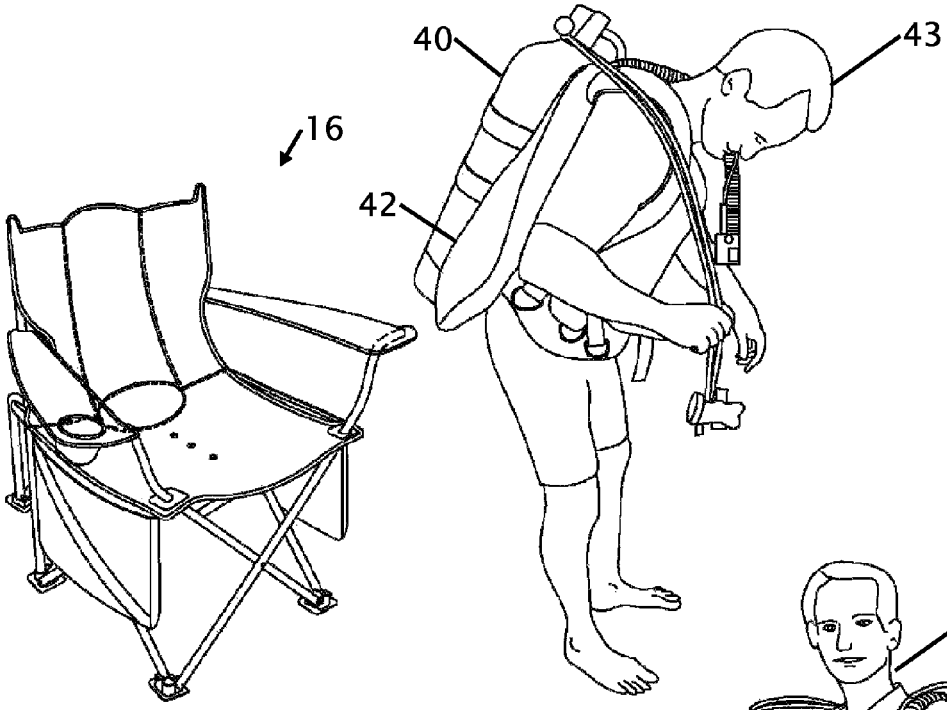
FIG. 9 shows the device of FIG. 8 with the user and secured SCUBA equipment.
Figure 10:
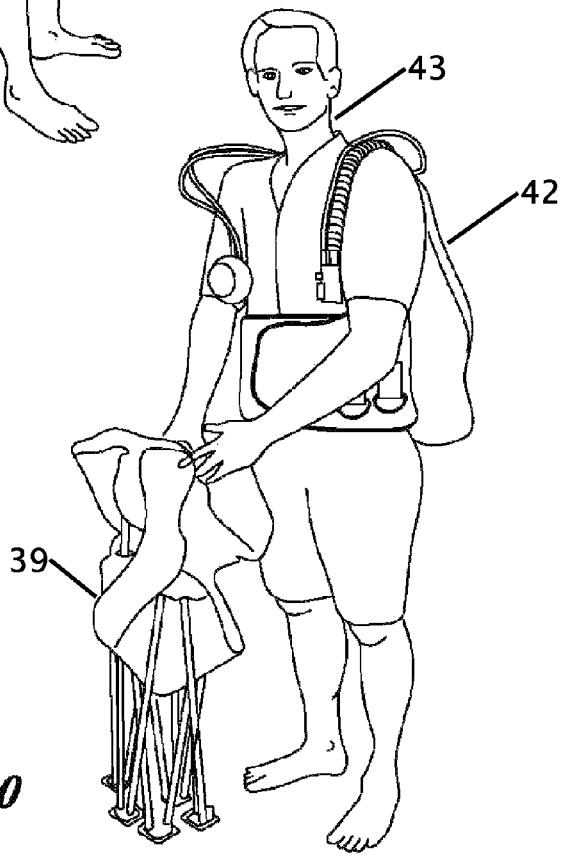
FIG. 10 shows the device of FIG. 8 in its folded configuration, in accordance with certain preferred embodiments of the present SCUBA equipment assembly platform.

Referring to FIG. 1, the SCUBA equipment assembly platform 16 of the present SCUBA equipment assembly platform includes a metal tube frame 19 used to support four corners of a foldable seating implement. The metal tube frame is connected by metal rod pins 20 that hinge through crossed metal tubes to allow for folding and unfolding as shown in FIGS. 9 and 10. The SCUBA equipment assembly also includes a backrest 11 and seating area 23 that preferably comprises a heavy-duty nylon fabric material that can be stretched when the unassisted SCUBA equipment assembly is opened for use (FIG. 9), and then folded for storage and transport (FIG. 10).

Figure 3:
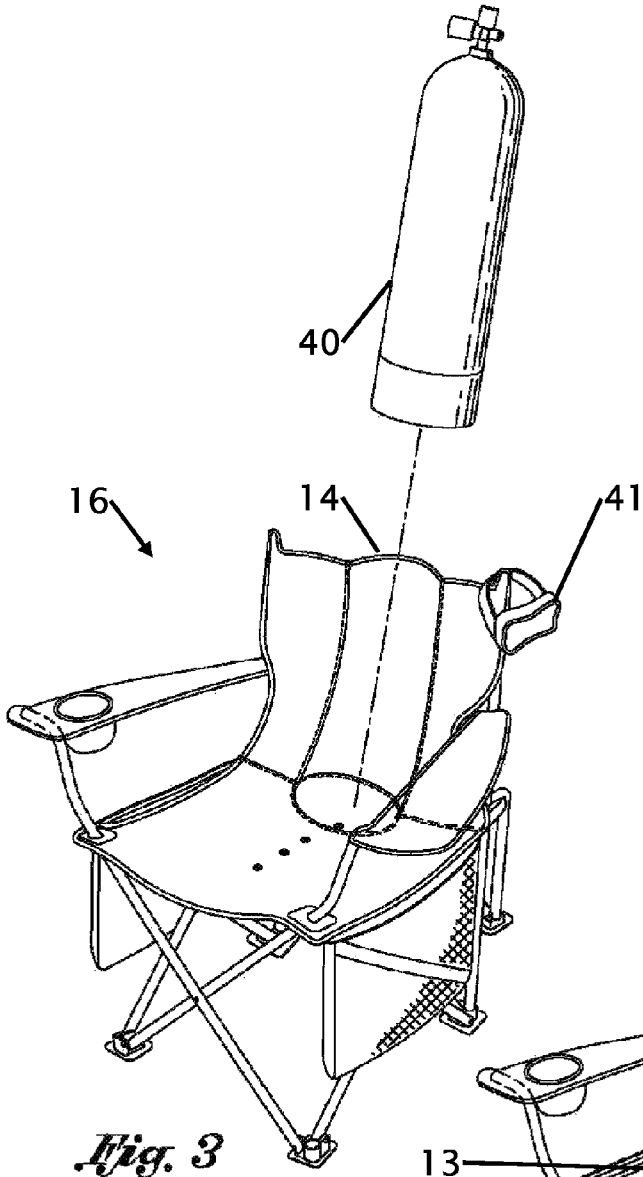
FIG. 3 shows the device of FIG. 1 with a SCUBA tank being inserted, as well as accommodation of an additional piece of SCUBA equipment, in accordance with certain preferred embodiments of the present SCUBA equipment assembly platform.
Figure 4:
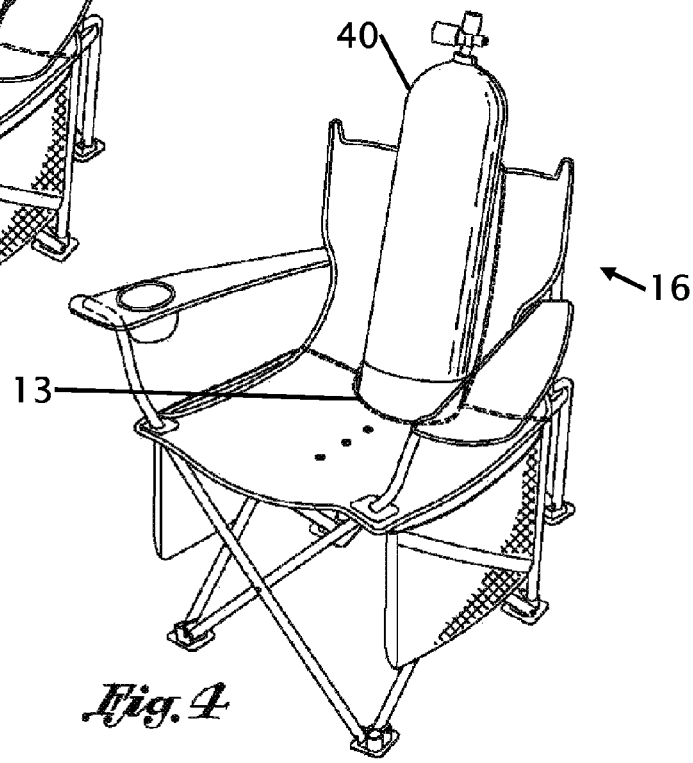
FIG. 4 shows the device of FIG. 1 including insertion of the SCUBA tank.
Figure 8:
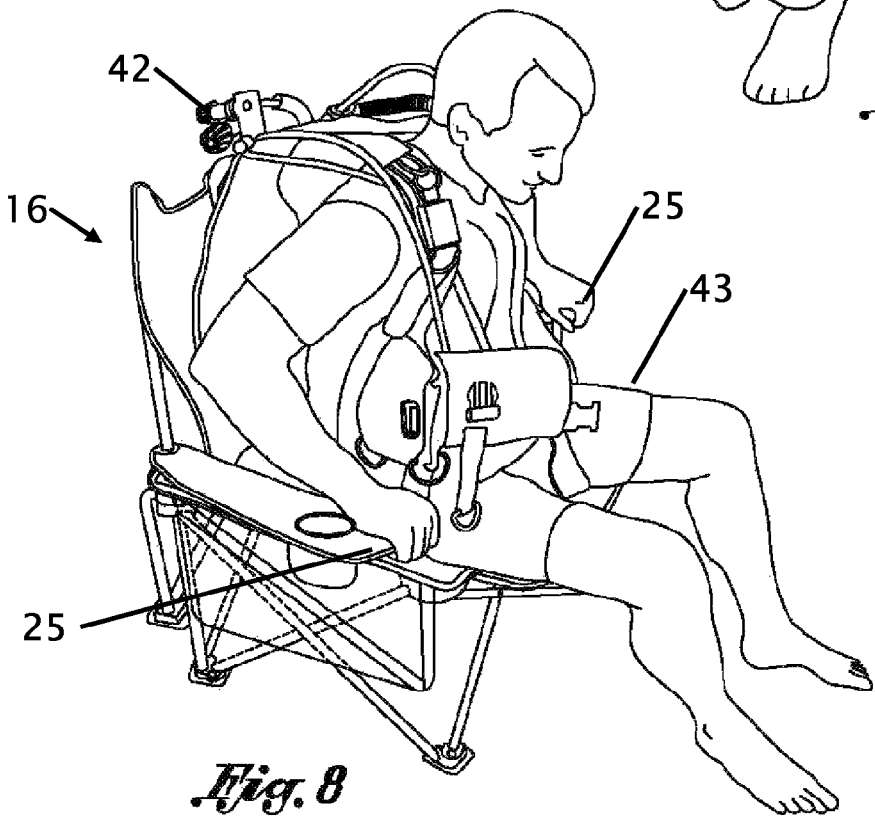
FIG. 8 shows a side elevation view of the device shown in FIG. 5 with the user and secured SCUBA equipment.

The seating area 23 includes a recess 13 located at the midline rear portion of the seating area 23. The recess 13 accommodates the base or bottom section of a SCUBA air tank, as shown in FIGS. 3 and 4. The recess 13 is configured for the bottom of an air tank to sit below the seating surface 16, as shown in FIGS. 3 and 4, forming a trough which prevents the base of the SCUBA air tank from shifting in an errant direction and allows the shoulder straps of a buoyancy compensator vest attached to the air tank to rest atop a seated diver's shoulders, as shown in FIG. 8. The unassisted SCUBA equipment assembly preferably includes at least one fluid draining eyelet hole 12 located near the center of the recess 13. It is also preferable for the seating area 23 to have a number of fluid draining eyelet holes 17 located near the center of the seating means. Alternatively, it is preferred for the seating area to have a section of webbing, mesh or otherwise fluid draining material.

Figure 2:
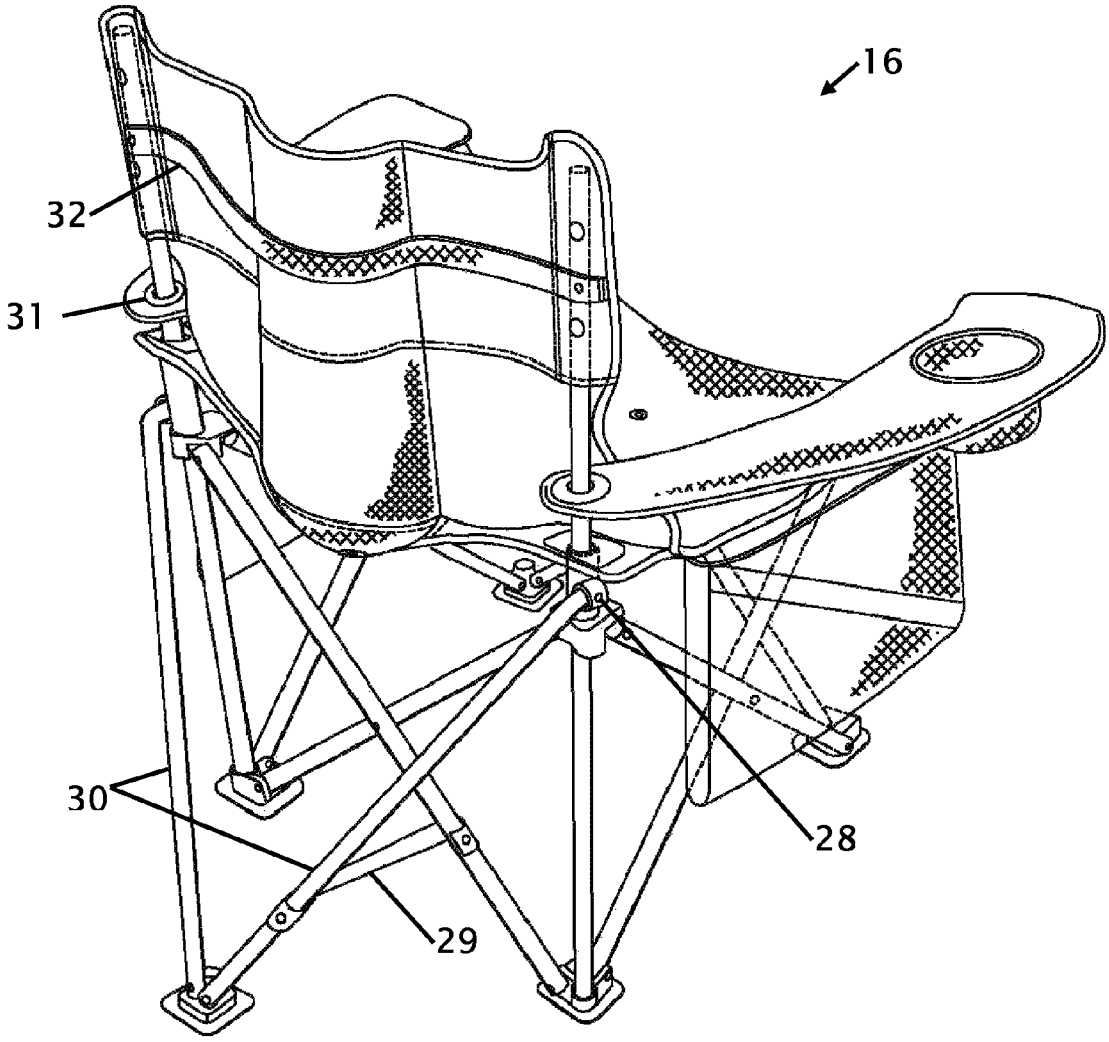
FIG. 2 shows a rear oblique elevation view of the device shown in FIG. 1.

Referring particularly to FIG. 2, it is therefore desirable that the seating implement includes additional legs 30 pivotally connected to the rear portion of the seating implement metal tube frame to provide further back load support. Each additional leg 30 is connected to the metal tube frame by a sliding hinge 28 that allows for folding and unfolding as shown in FIGS. 9 and 10. In an alternative embodiment an auger screw can be screwed through one or more feet to anchor the unassisted SCUBA equipment assembly in the sand.

The backrest 11 also includes a vertical recess 14 located along the midline of the backrest 11 that extends from the seating recess 13 up to the top edge of the backrest 11. The vertical recess 14 is angled on an incline relative to the seating backrest 11 on either side through the entirety of the pocket's course from the base of the recess 13 to the top edge of the seating backrest 11. The angled, vertical recess 14 cradles a SCUBA air tank and prevents it from shifting from side to side, as shown in FIGS. 3 and 4.

The combination of both the seating recess 13 and the vertical recess 14 along the seating backrest 11 allows for a full-size SCUBA air tank to be placed upright for full assembly of SCUBA equipment, as shown in FIGS. 3 through 8. The present SCUBA equipment assembly platform's SCUBA air tank holding system maintains the SCUBA air tank in an upright position for unassisted attachment of a buoyancy compensator vest. Once fastened to the air tank, the buoyancy compensator vest can then sit atop the seating means and rest along the seating backrest 11 shown in FIGS. 5 and 6.

Referring particularly to FIG. 2, at least one linear support strip 32 is connected at each lateral side of the seating implement backrest 11 that extends transversely across a back portion of the backrest 11. The linear support strip 32 provides ancillary support to augment backrest 11 sturdiness.

FIG. 3 shows a SCUBA tank 40 being inserted into the recess 13, as well as accommodation of an additional piece of SCUBA equipment, such as a mask 41, in accordance with the preferred embodiments of the present SCUBA equipment assembly platform 16. The recess 13 as shown in FIG. 4 with the tank 14 placed in the recess 13. In the preferred embodiment the tank 14 sits below the seating surface as it might normally exist when the tank is on a SCUBA diver.

Figure 5:
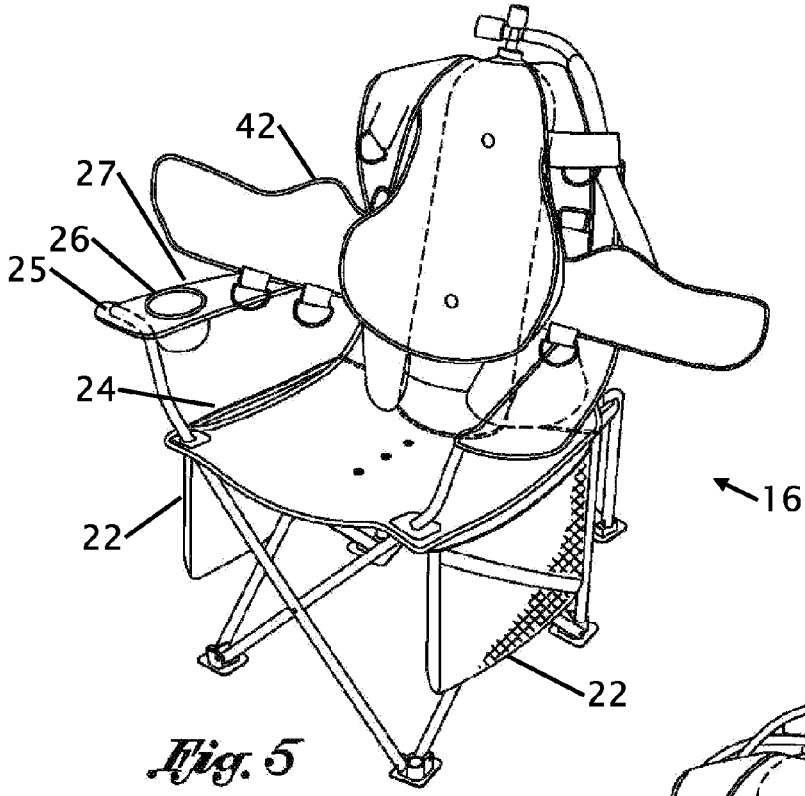
FIG. 5 shows the device of FIG. 4 including attachment of a buoyancy compensator vest to the SCUBA tank.
Figure 6:
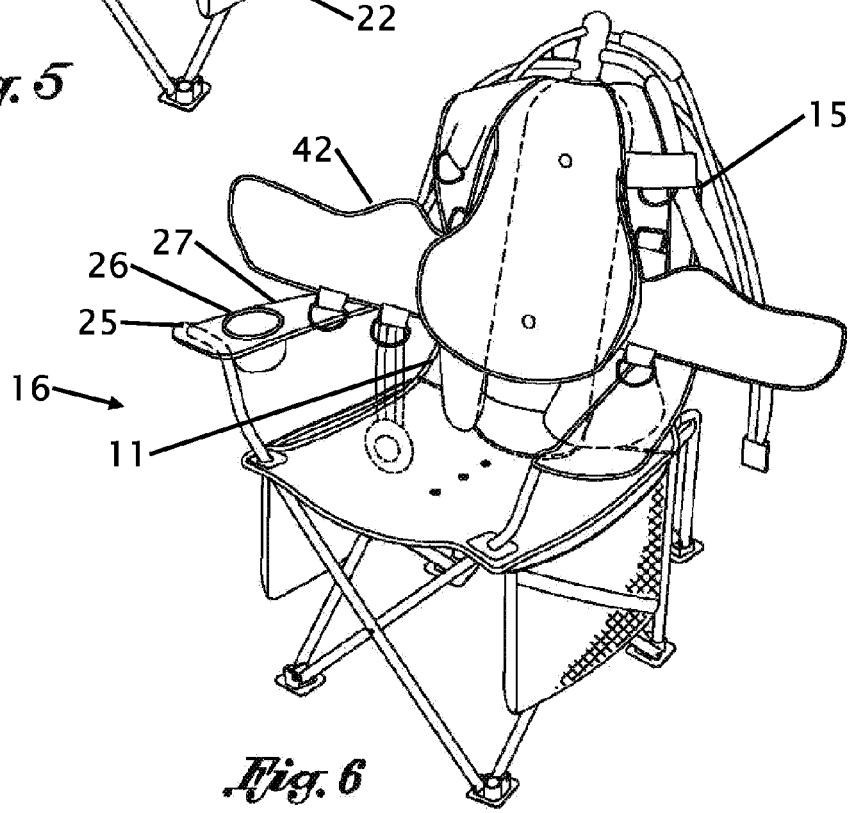
FIG. 6 shows the device of FIG. 5 including attachment of further additional SCUBA equipment to the buoyancy compensator.

A SCUBA diving air tank is then loaded vertically into the seating recess 13 and the recess along the seating vertical recess 14, as shown in FIGS. 3 and 4. Additional SCUBA diving equipment can then be connected to the SCUBA diving air tank as the air tank rests in the seating surface 16, as shown in FIGS. 5 and 6. The additional equipment that is usually connected to the air tank includes a buoyancy compensator vest, air regulator, computer, compass and other gauges, and airflow and monitor tubing.

When a buoyancy compensator vest 42 is resting on the seating means of the device as shown in FIGS. 5 and 6 the buoyancy compensator 42 wings may extend outside the boundaries of the seating platform 16. The unassisted SCUBA equipment assembly therefore preferably includes at least one adjustable armrest 27 on each lateral side of the seating implement that is connected at its proximal portion to the frame by a sliding adjustable ring 31 (Not visible in these figures) to stabilize the buoyancy compensator wings. It is further desirable to construct the armrests 27 of a substantially sturdy material so that the weight of the wings, as well as any additional gear that is connected to the buoyancy compensator—including an air regulator, computer, compass, and airflow and monitor tubing, may be supported above the ground surface shown in FIG. 6. It is even further desirable to include hand rests 25 at the distal ends of the armrests 27 for added support when a diver is standing up from atop the seating means. The armrests 27 may also include a cup holder 26 for placing various small SCUBA accessories.

The unassisted SCUBA equipment assembly also preferably includes a pair of raised back corner posts 15 that extend higher than the seating backrest 11 for holding hooked or looped SCUBA equipment.

The unassisted SCUBA equipment assembly also preferably includes pouch pockets 22 connected to each lateral side of the seating means for storing SCUBA diving fins, gloves and camera. It is further preferable for each pouch pocket 22 to have at least one fluid draining eyelet hole 18 (shown in FIG. 1) located near the bottom of the pouch pocket 22. In the preferred embodiment the pouch pockets 22 are closed at their top edges using a hook and loop closing system 24. The pouch pockets 22 can also be marked by indicia such as that associated with divers, or any other indicia selected by the user.

The additional weight of a SCUBA diving apparatus may provide substantial burden on the rear portion of the seating device when loaded as shown in FIGS. 5 and 6. By way of example, a typical non-specialized seating implement may have a tendency to tip over in a backward fashion due to the distribution of weight.

To append further stability to the rear portion of the seating implement at least one of the pivotally connected additional legs 30 is additionally connected to the rear portion of the metal tube frame by a support strip 29. It is desirable to construct the support strip 29 of a heavy-duty nylon fabric material that can be stretched when the device is opened for use and then folded for device storage and transport shown in FIGS. 9 and 10.

At the lower portion of each of the device's additional legs 30 and metal tubes 19 supporting the four corners of the foldable seating implement it is preferable to have rubber foot pads 21 to traverse the shifting surface of sand or dirt. It is further preferable to have the rubber foot pads connected to the metal tubes by metal pin rods that allow for the metal tube frame to fold as shown in FIG. 10.

Both the metal tube frame 19 and the pivotally connected additional legs 30 are preferably constructed from materials which are impermeable to water and particularly salt water environments, and which are also light in weight to facilitate ease of carrying and transport. To this end, the metal tube frame 19 and the pivotally connected additional legs 30 are preferably constructed of materials such as plastics or aluminum.

Although the seating surface platform 16 of the present SCUBA equipment assembly platform is adapted for use by SCUBA divers, other applications of the seating implement may be utilized for other recreational activities. The following description of the operation of the seating surface 16 of the present SCUBA equipment assembly platform is presented using SCUBA diving operations as the example.

In operation a SCUBA diver would unfold the seating surface platform 16 upon arrival near the SCUBA diving site and place it upright on a level surface, such that all rubber foot pads 21 of the metal tube frame 19 are in contact with the ground. Typical ground surfaces near SCUBA diving sites consist of sand, dirt, grass or paved roadway.

Ancillary SCUBA diving equipment not directly attached to the SCUBA diving air tank may be placed in either of the pouch pockets 22 or hung from either of the seating implement's raised back corner posts 15. This may include SCUBA diving fins, gloves, weights, knife, emergency and signaling equipment, and camera.

Figure 7:
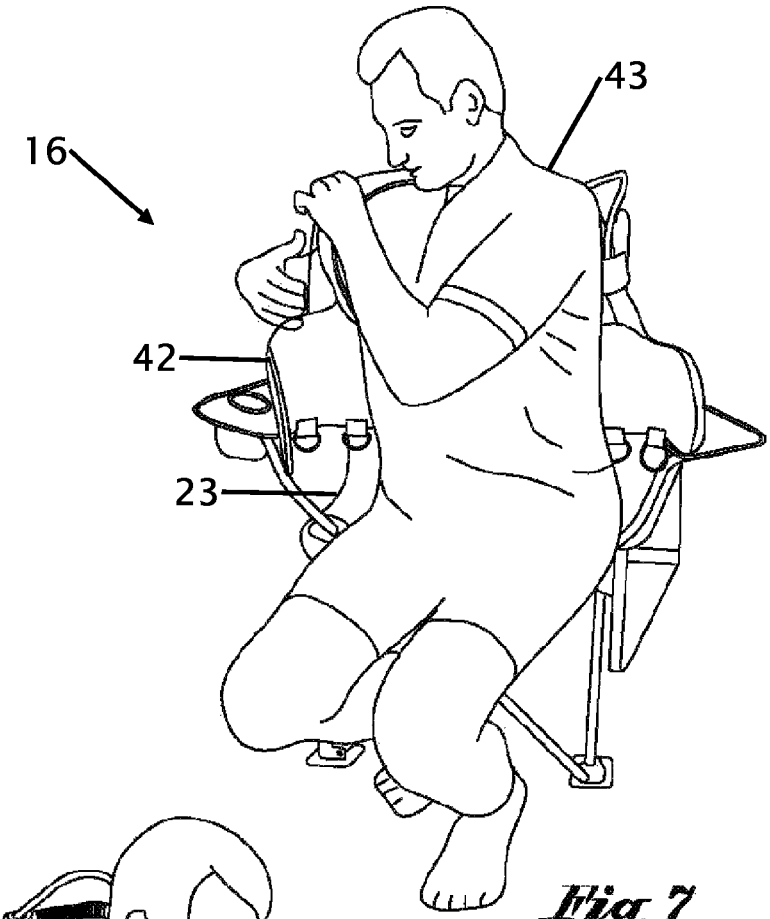
FIG. 7 shows the device of FIG. 5 with a user donning the buoyancy compensator, in accordance with certain preferred embodiments of the present SCUBA equipment assembly platform.

The diver then sits onto the seating area 23 aligning his or her back along the plane of the buoyancy compensator vest, shown in FIG. 7. The diver can then don the buoyancy compensator vest and secure additional SCUBA diving equipment while seated in the seating surface 16, shown in FIGS. 7 and 8. The seating implement may then be refolded for further transport and storage, as shown in FIGS. 9 and 10. FIG. 8 shows the SCUBA diver 43 with a hand on one or both hand rests 25 that the SCUBA diver can use to push on to lift himself up from the seat and out of the seating platform 16.

FIG. 9 shows the device of FIG. 8 with the user and secured SCUBA equipment while FIG. 10 shows the seating platform 16 in a folded or collapsed orientation 39. In these figures the SCUBA diver 43 is shown fitted with the tank 40 and the buoyancy compensator vest 42.

When the diver 43 has completed his diving and is ready to remove his SCUBA diving equipment, he unfolds the unassisted SCUBA equipment assembly and reverses the process of donning the equipment. The SCUBA diver 43 sits onto the seating means and unfastens the buoyancy compensator vest and other equipment. The fluid draining eyelet holes or webbing/mesh material 17 enable water or other fluids on the equipment to drain out and allow the equipment to dry. The seating implement may then be folded 39 for transport and storage as previously described.

Thus, specific embodiments of a SCUBA equipment assembly platform herein have been described with reference to particular embodiments, it is to be understood that the embodiments described herein are merely exemplary of the principles and applications of the present SCUBA equipment assembly platform. It is therefore to be understood that numerous modifications may be made to the illustrative embodiments without departing from the sphere and scope of the present SCUBA equipment assembly platform. All such variations and other arrangements that may be devised are intended to be included in the spirit and scope of the present SCUBA equipment assembly platform. The inventive subject matter, therefore, is not to be restricted except in the spirit of the appended claims.

The invention claimed is:

1. An unassisted SCUBA equipment assembly platform comprising:

a collapsible frame structure;

at least one seating surface secured to said frame structure having a recess means for locating a base of a SCUBA tank wherein said recess means has a base that sits below said at least one seating surface, said recess means configured so that the base of the SCUBA tank sits below said at least one seating surface when inserted into said recess means, and at least one backrest secured to said frame structure having a means for supporting elongated cylindrical sides of said SCUBA tank.

2. The unassisted SCUBA equipment assembly according to claim 1 that further includes at least one armrest.

3. The unassisted SCUBA equipment assembly according to claim 1 that further includes at least one pouch.

4. The unassisted SCUBA equipment assembly according to claim 3 wherein said at least one pouch includes at least one hole, mesh or web for drainage.

5. The unassisted SCUBA equipment assembly according to claim 1 wherein said backrest has a backward bias to prevent said tank from tipping out of said recess means.

6. The unassisted SCUBA equipment assembly according to claim 1 wherein said backrest is configured with a concave shape to allow said tank to self-center on said backrest.

7. The unassisted SCUBA equipment assembly according to claim 1 wherein said recess means is connected to said seating surface.

8. The unassisted SCUBA equipment assembly according to claim 1 wherein said recess means further includes at least one drain hole.

9. The unassisted SCUBA equipment assembly according to claim 1 that further includes an upper support extending along a top of said backrest structure configured for supporting shoulder straps of a buoyancy compensator.

10. The unassisted SCUBA equipment assembly according to claim 1 wherein said at least one seating surface includes at least one hole for drainage.

11. The unassisted SCUBA equipment assembly according to claim 1 that further includes at least two posterior legs.

12. The unassisted SCUBA equipment assembly according to claim 11 wherein said posterior legs are pivotally connected to said frame structure.

13. The unassisted SCUBA equipment assembly according to claim 11 wherein said posterior legs further includes a tether to limit extension of said posterior legs.

14. The unassisted SCUBA equipment assembly according to claim 1 wherein said frame is at least partially covered with vinyl, fabric, cloth, canvas, nylon, leather or a combination thereof.

15. The unassisted SCUBA equipment assembly according to claim 1 wherein said backrest further includes at least one support strip.

16. The unassisted SCUBA equipment assembly according to claim 1 that further includes at least a second seating surface where said at least second seating surface is placed beside or behind said at least one seating surface.

17. The unassisted SCUBA equipment assembly according to claim 1 that is erected by spreading said metal frame to expand said at least one seating surface as a means for providing an assembly and donning surface for a seated SCUBA diver.

18. The unassisted SCUBA equipment assembly according to claim 17 that provides sufficient structural support for said SCUBA diver to exert force on said assembly to push said SCUBA diver up from said assembly.

19. The unassisted SCUBA equipment assembly according to claim 1 wherein said seating surface means further includes a section of webbed, mesh or otherwise fluid draining material.

* * * * *